US005894765A

United States Patent [19]

Anderson et al.

[11] Patent Number: 5,894,765

[45] **Date of Patent: *Apr. 20, 1999**

[54] REAR RATCHET DRIVE MULTIPLE BIT TOOL

[76] Inventors: Wayne Anderson; Warren Anderson; Paolo Cassutti, all of 171 Brook Ave., Deer Park, N.Y. 11729

[ * ] Notice: This patent issued on a continued prosecution application filed under 37 CFR 1.53(d), and is subject to the twenty year patent term provisions of 35 U.S.C. 154(a)(2).

[21] Appl. No.: 08/744,794

[22] Filed: Nov. 5, 1996

Related U.S. Application Data

[63] Continuation of application No. 08/451,441, May 26, 1995, abandoned.

[51] Int. Cl.[6] ..... B25B 13/46; B25G 1/08

[52] U.S. Cl. ..... 81/60; 81/177.4; 81/490; 81/439

[58] Field of Search ..... 81/58, 58.4, 60–63.2, 81/490, 437–439, 177.4

[56] References Cited

U.S. PATENT DOCUMENTS

| | | | |
|---|---|---|---|
| 2,476,762 | 7/1949 | Petre et al. | 81/438 X |
| 2,641,478 | 6/1953 | Sigg . | |
| 3,114,401 | 12/1963 | Johnson . | |
| 3,824,881 | 7/1974 | Wright | 81/63 |
| 4,300,607 | 11/1981 | Mellinger | 81/490 |
| 4,448,097 | 5/1984 | Rocca | 81/438 X |
| 5,450,775 | 9/1995 | Kozak | 81/177.4 X |

FOREIGN PATENT DOCUMENTS 403769 1/1934 United Kingdom .

*Primary Examiner*—D. S. Meislin

*Attorney, Agent, or Firm*—Lackenbach Siegel Marzullo Aronson & Greenspan, P.C.

[57] ABSTRACT

A ratcheting tool, such as a screwdriver having multiple reversible bits in which a ratchet assembly is located in the screwdriver handle closer to the rear end of the handle, being the end opposite the screwdriver shank. Extending from the ratchet in a direction toward the shank, but at least partially within the handle, is a ratchet drive tube having an interior cross-section which is hexagonal. The screwdriver shank is a tube with both ends,having hexagonal interior cross-sections into which interchangeable double-ended drive bits with mating hexagonal shoulders may be partially inserted, with a portion of each hexagonal shoulder remaining exposed. The exposed portion of the hexagonal shoulder opposite the bit selected for use is inserted into the mating hexagonal ratchet drive tube. Driving rotation of the handle is transmitted to the selected bit in use through the ratchet and ratchet drive tube to the shoulder of the unselected bit, to the screwdriver shank and to the shoulder of the selected bit. Each double-ended bit may be reversed in the shank and the shank may be reversed in the ratchet drive tube. Means are provided in a modified embodiment to restrain the ratchet from being pushed out of the handle under applied force of use.

2 Claims, 4 Drawing Sheets

REAR RATCHET DRIVE MULTIPLE BIT TOOL

This application is a continuation of application Ser. No. 08/451,441, filed May 26, 1995, now abandoned.

BACKGROUND OF THE INVENTION

Ratcheting screwdrivers are known as are reversible bit screwdrivers, the latter having a reversible bit for a 2-in-1 screwdriver or two reversible bits in a reversible shank for a 4-in-1 screwdriver. The present invention is intended to provide a combination of the convenience of a multiple-bit screwdriver, especially a 4-in-1, with the usefulness of a ratcheting screwdriver in a construction strong enough for industrial or professional use.

SUMMARY OF THE INVENTION

The present invention provides a multiple-bit ratcheting screwdriver in which the rotational driving force is transmitted from the ratchet to the bit in use through a strong steel to steel path, with means to prevent axial pressure from pushing the ratchet out of the handle.

In a preferred embodiment, the present invention provides a ratcheting screwdriver having multiple reversible bits in which a ratchet is located in the screwdriver handle closer to the rear end of the handle, being the end opposite the screwdriver shank. Extending from the ratchet in a direction toward the shank, but at least partially within the handle, is a ratchet drive tube having an interior cross-section which is hexagonal. The screwdriver shank is a tube with both ends having hexagonal interior cross-sections into which interchangeable double-ended drive bits with mating hexagonal shoulders may be partially inserted, with a portion of each hexagonal shoulder remaining exposed. The exposed portion of the hexagonal shoulder opposite the bit selected for use is inserted into the mating hexagonal ratchet drive tube. Driving rotation of the handle is transmitted to the selected bit in use through the ratchet and ratchet drive tube to the shoulder of the unselected bit, to the screwdriver shank and to the shoulder of the selected bit. Each double-ended bit may be reversed in the shank and the shank may be reversed in the ratchet drive tube.

In another embodiment, the screwdriver shank has ears or wings formed in the outer surface thereof, with the ratchet drive tube having mating internal grooves to receive the ears for transmission of both the rotational and axial driving forces. This embodiment of the invention further provides means to restrain the ratchet from being pushed out of the handle under applied force of use, comprising a push nut or push washer bearing between a circumferential groove in the outer surface of the ratchet drive tube and the base of the handle.

The ratchet may be either reversible (2-way) or reversible and lockable (3-way).

DESCRIPTION OF THE PREFERRED EMBODIMENT

Figure 1:
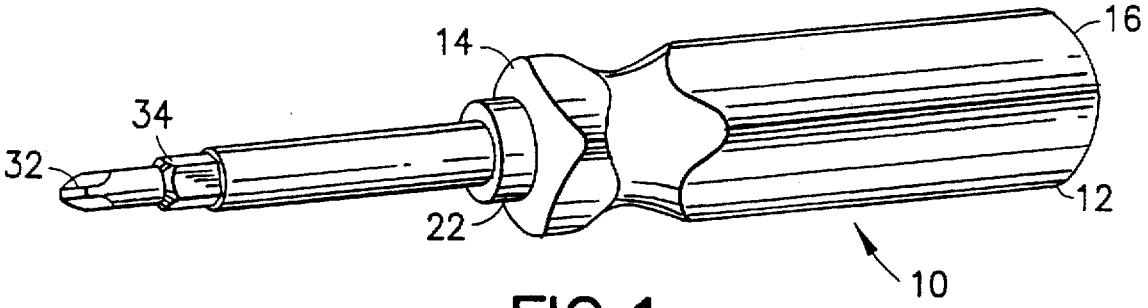
FIG. 1 is a perspective view of the preferred embodiment of the rear ratchet drive multiple bit screwdriver of the invention.

With reference to the drawing, the rear ratchet drive multiple bit screwdriver of the invention 10 comprises a handle 12 having a shank end 14 and, opposite, a rear end 16. Handle 12 is of conventional molded hand-holdable configuration and has a central cavity 18 extending axially therethrough.

A ratchet assembly 20 of conventional reversible design is provided in a size adapted to be inserted into cavity 18 and fixed against rotation with respect thereto. While the axial location of ratchet assembly 20 within handle 12 may be varied, it is preferred to be adjacent rear end 16 thereof. Extending from ratchet assembly 20 in a direction toward shank end 14 is a ratchet drive tube 22 having a hollow interior 24 the cross-section of which is hexagonal.

Figure 2:
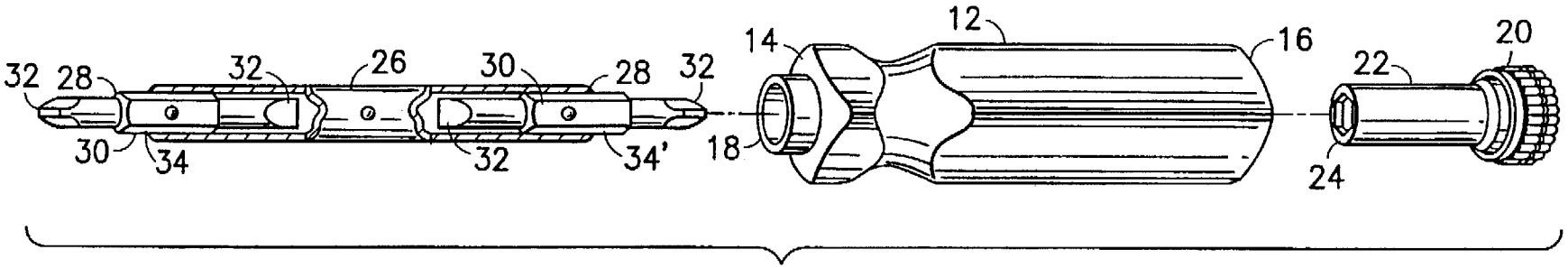
FIG. 2 is an exploded perspective view of the preferred embodiment of the rear ratchet drive multiple bit screwdriver of the invention.

A screwdriver shank 26 as best shown in FIG. 2 is provided and is a hollow tube the ends 28 of which are similar and have hexagonal interior cross-sections. Reversible screwdriver bits 30 are of conventional design, having dissimilar bit ends 32 to provide a choice of drive bits, such as different sizes of cross-cut and Phillips, a trademark of H. H. Phillips Tools, Inc., of Tampa, Fla., drive bits, with a central shoulder 34 therebetween of hexagonal cross-section. Reversible screwdriver bits 30 may be inserted into shank ends 28 with hexagonal shoulders 34 mating with the hexagonal shape of each shank end 28 such that there is no relative rotational motion therebetween. A portion of each hexagonal shoulder 34 remains exposed. The exposed portion of the hexagonal shoulder 34' opposite the bit end 32' selected for use is inserted into the mating hexagonal ratchet drive tube 22, as shown in FIG. 2, such that there is no relative rotational motion therebetween. Rotational drive motion is accordingly imparted from handle 12 to ratchet assembly 20 to ratchet drive tube 22 to reversible bit shoulder 34 therein to shank 26 to reversible bit shoulder 34 at the drive end to bit end 32 selected for use.

Figure 1A:
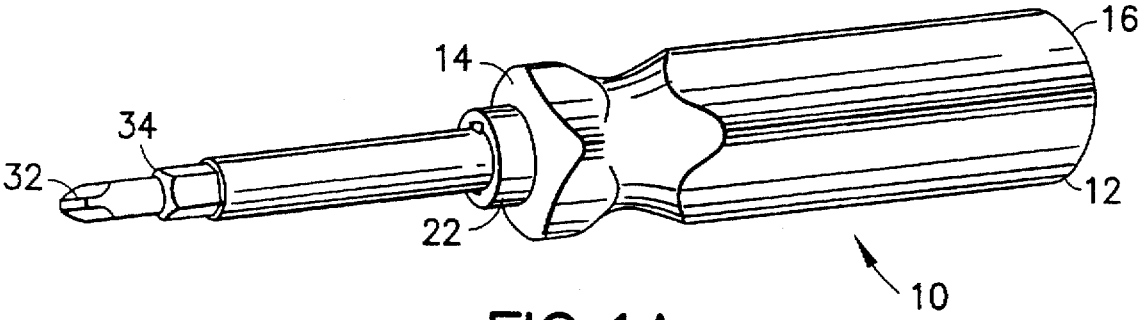
FIG. 1A is a perspective view of the modified embodiment of the rear ratchet drive multiple bit screwdriver of the invention.
Figure 3:
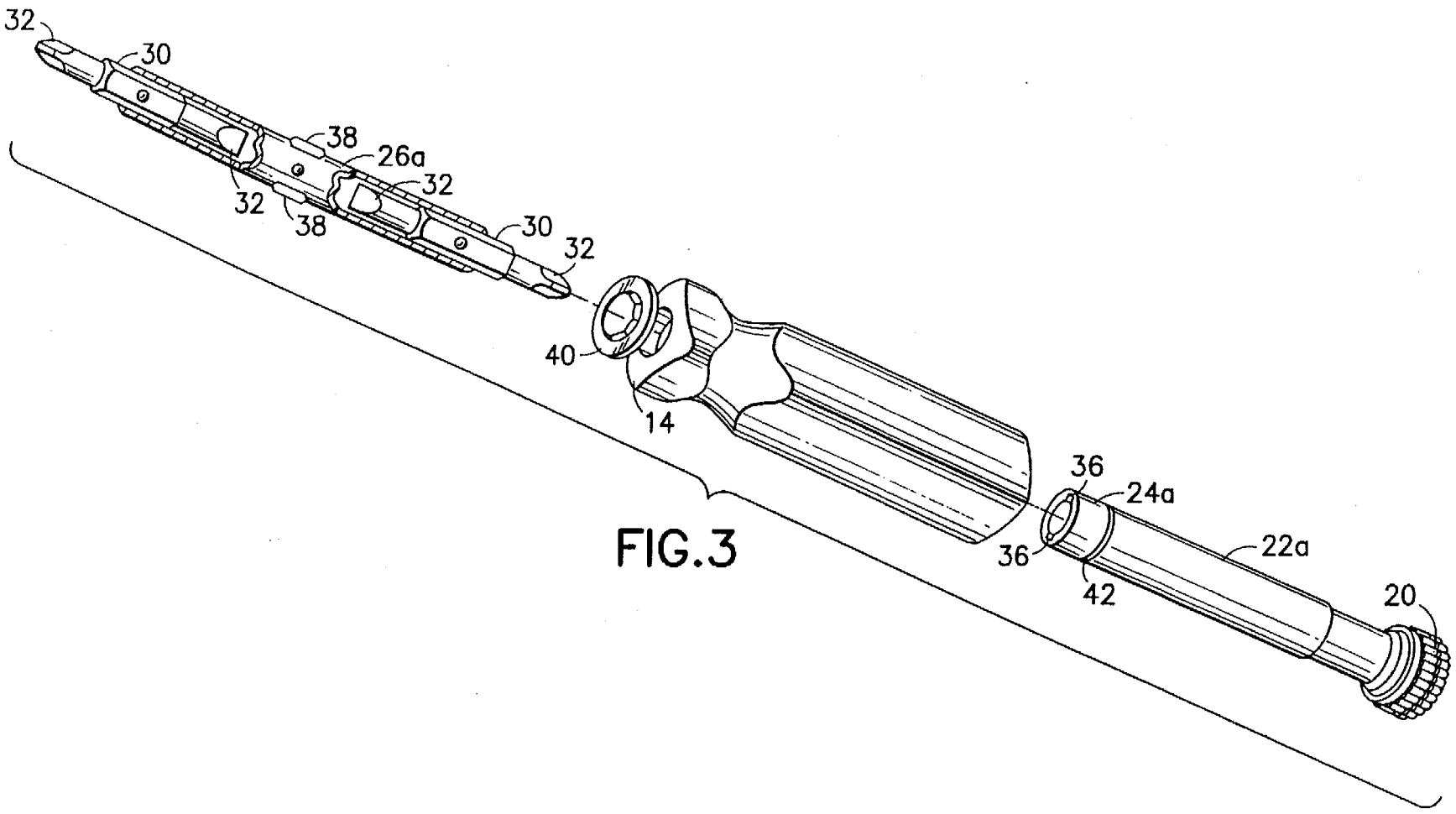
FIG. 3 is an exploded perspective view of the modified embodiment of the rear ratchet drive multiple bit screwdriver of the invention.
Figure 4:
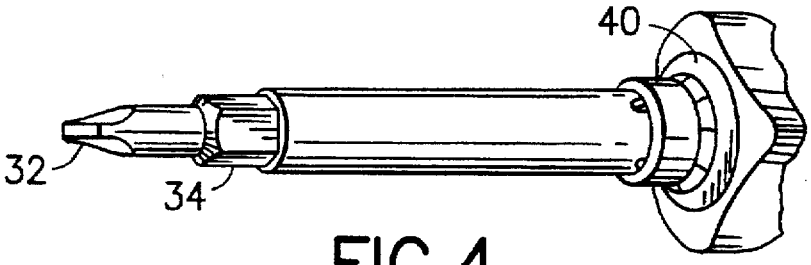
FIG. 4 is a fragmentary perspective view of the modified embodiment of the rear ratchet drive multiple bit screwdriver of the invention.
Figure 5:
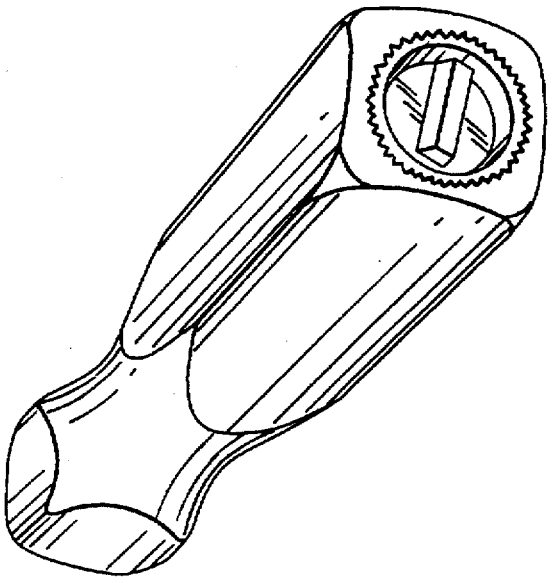
FIG. 5 is a perspective view of the ear of the handle of the rear ratchet drive multiple bit screwdriver of the invention.
Figure 6:
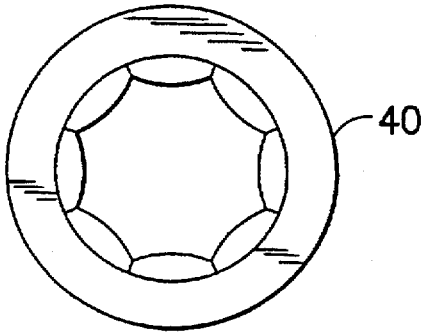
FIG. 6 is a plan view of the push nut of the rear ratchet drive multiple bit screwdriver of the invention.

In an alternate embodiment is shown in FIGS. 1A, 3 and 4, end **24*a* of ratchet drive tube 22*a* is provided with internal grooves 36, rather than a hexagonal shape, and shank 26*a* is provided with external ears or wings 38 adapted to engage and mate with grooves 36. In this embodiment, rotational drive force is transmitted from ratchet drive tube 22*a* directly to shank 26*a* without going through the shoulder of a reversible bit. Additionally, the depth of each groove 36 limits the extent to which shank 26*a* may be inserted and provides axial force from handle 12 to shank 26*a* and thence to bit 32** in use.

Axial force may also be provided from handle 12 to shank **26*a* by a push nut 40 having an inner diameter formed by a plurality of beveled segments having radially extending slits, as best shown in FIGS. 1A, 3–4 and 6 between a circumferential groove 42 on ratchet drive shank 22*a* and the end 14 of handle 12 adjacent shank 26*a*. Push nut 40 prevents multiple bit screwdriver 10 from coming apart when force is placed on screwdriver bit end 32** and pressure is put on the bit in an axial direction.

It will be appreciated that the invention may be used with nut drivers and the like instead of or in conjunction with screwdrivers.

What is claimed is:

1. A ratchet multiple tool bit drive screwdriver comprising:

handle means being formed with a hollow tubular recess, said handle means comprising a proximate end and a distal end, and having respective openings at said proximate and distal ends, ratchet drive means operably disposed in said hollow tubular recess, said ratchet drive means comprising ratchet drive tube means, said ratchet drive tube means being operably disposed in said hollow tubular recess and extending from said proximate end opening to about said distal end opening;

shank means for holding a plurality of tool bit drive means, said shank means being formed for slidable removable retention in said ratchet drive tube means, said shank means comprising a cavity having a hexagonal cross-section;

two tool bit drive means, each said tool bit drive means being formed with a hexagonal body portion for selected slidable removable insertion in said shank means cavities and being further provided with oppositely disposed tool bit drives so that with insertion of the tool bit drives in the shank means, and the shank means disposed in the ratchet drive tube means, one of the tool bit drives is distally operably disposed, said ratchet drive tube means having push washer means for retaining said ratchet drive tube means in said handle means adjacent the distal opening of said handle means;

whereby with the shank means operably disposed in the ratchet drive tube means with operable retention of the ratchet drive tube means, the ratchet drive means drives the distally disposed tool bit drive.

2. The screwdriver according to claim 1, wherein said pusher washer means bears between a circumferential groove in an outer surface of said ratchet drive tube means and said distal end of said handle means.

* * * * *